US005653032A

United States Patent [19]

Sikka

[11] Patent Number: 5,653,032

[45] Date of Patent: Aug. 5, 1997

[54] IRON ALUMINIDE KNIFE AND METHOD THEREOF

[75] Inventor: Vinod K. Sikka, Oak Ridge, Tenn.

[73] Assignee: Lockheed Martin Energy Systems, Inc., Oak Ridge, Tenn.

[21] Appl. No.: 566,466

[22] Filed: Dec. 4, 1995

[51] Int. Cl.[6] ..... B26B 9/00

[52] U.S. Cl. ..... 30/350; 30/346.54; 420/79

[58] Field of Search ..... 30/346.53, 346.54, 30/350; 148/320, 333; 420/79

[56] References Cited

U.S. PATENT DOCUMENTS

| | | | |
|---|---|---|---|
| 3,034,379 | 5/1962 | Bernstein et al. | 148/333 |
| 3,871,836 | 3/1975 | Polk et al. | 30/346.54 |
| 3,900,636 | 8/1975 | Curry et al. | 30/346.55 |
| 3,911,797 | 10/1975 | Kastner | 93/1 C |
| 3,974,727 | 8/1976 | Stehlin | 83/174 |
| 4,259,126 | 3/1981 | Cole et al. | 420/79 |
| 4,287,007 | 9/1981 | Vander Voort | 30/350 |
| 4,309,051 | 1/1982 | Vansteelant | 289/2 |
| 4,550,757 | 11/1985 | Berchem | 152/228 |
| 4,961,903 | 10/1990 | McKamey et al. | 420/79 |
| 5,084,109 | 1/1992 | Sikka | 148/12 R |
| 5,158,744 | 10/1992 | Nazmy | 420/79 |
| 5,238,645 | 8/1993 | Sikka et al. | 420/79 |

FOREIGN PATENT DOCUMENTS

| | | | |
|---|---|---|---|
| 794568 | 9/1968 | Canada | 30/346.54 |
| 1104932 | 3/1968 | United Kingdom | 30/346.54 |

OTHER PUBLICATIONS

I. Baker and P. Nagpal, "A Review of the Flow and Fracture of FeAl," *Structural Intermetallics,* Eds., R. Darollis, J.J. Lowandowski, C.T. Liu, P.I. Martin, D.B. Miracle, and M.V. Nafhal, The Minerals, Metals & Materials Society, 1993.

*Primary Examiner*—Hwei-Siu Payer

*Attorney, Agent, or Firm*—Ivan L. Ericson; Harold W. Adams

[57] ABSTRACT

Fabricating an article of manufacture having a $Fe_3Al$-based alloy cutting edge. The fabrication comprises the steps of casting an $Fe_3Al$-based alloy, extruding into rectangular cross section, rolling into a sheet at 800° C. for a period of time followed by rolling at 650° C., cutting the rolled sheet into an article having an edge, and grinding the edge of the article to form a cutting edge.

3 Claims, 1 Drawing Sheet

IRON ALUMINIDE KNIFE AND METHOD THEREOF

This invention was made with Government support under contract DE-AC05-84OR21400 awarded by the U.S. Department of Energy to Lockheed Martin Energy Systems, Inc. and the Government has certain rights in this Invention.

FIELD OF THE INVENTION

The present invention relates to an article of manufacture having a cutting edge and method thereof, more particularly, an iron aluminide article of manufacture having a cutting edge fabricated from iron aluminide and method thereof.

BACKGROUND OF THE INVENTION

Knives or cutting edges are used in every facet of life. However, the quick dulling of cutting edges remains a problem in their effective cutting ability. This becomes a serious issue in the manufacturing processes where cutting edges need frequent sharpening. The frequent sharpening not only slows down the production rate but also produces a lesser than desirable cutting edge. The present invention overcomes the problem of the need to frequently sharpen cutting edges because of the continuous use of the cutting edges typically in manufacturing processes.

OBJECTS OF THE INVENTION

Accordingly, it is an object of the present invention to provide a long-lasting cutting edge and a method of making the same. Further and other objects of the present invention will become apparent from the description contained herein.

SUMMARY OF THE INVENTION

In accordance with one aspect of the present invention, a new and improved article of manufacture comprises an article having a cutting edge fabricated from a $Fe_3Al$-based alloy. The method of fabricating the article having the cutting edge comprises the steps of casting a $Fe_3Al$-based alloy, extruding into rectangular cross section, rolling into a sheet at 800° C. followed by rolling at 650° C., cutting the rolled sheet into an article having an edge, and grinding the edge of the article to form an article having a cutting edge.

BRIEF DESCRIPTION OF THE DRAWING

In the drawing:

The Figure is a side view of a knife in accordance with the present invention.

Figure 1:
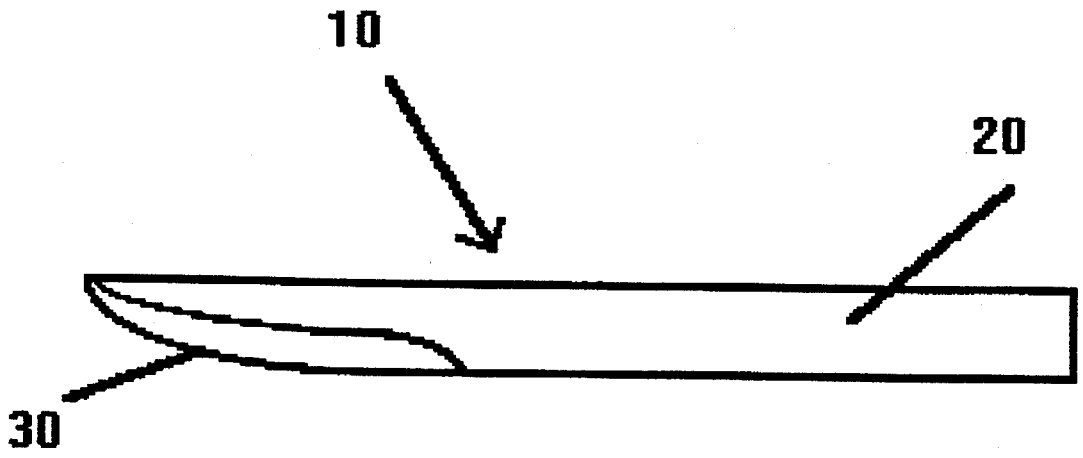

For a better understanding of the present invention, together with other and further objects, advantages and capabilities thereof, reference is made to the following disclosure and appended claims in connection with the above-described drawing.

DETAILED DESCRIPTION OF THE PREFERRED EMBODIMENTS

The present invention deals with knives made from a material which produces an edge that sharpens itself with each use. The new knife material also has the advantage that hardening treatments are not needed as compared to the currently used material. This new knife material has a lower density compared to steel, the typical knife material.

Shown in the Figure is a side view of knife 10 of the present invention. Knife 10 has a knife body 20 and a $Fe_3Al$-based alloy cutting-edge 30. The material for fabricating cutting edges in the present invention is based on iron-aluminide ($Fe_3Al$) compositions. The ductile compositions of $Fe_3Al$ alloys are listed in Table I. The following examples demonstrate the cutting-edge application of these compositions:

EXAMPLE 1

Iron aluminide based alloy FAL (see TABLE I) was used for the fabrication of a knife. FAL was east in air, hot extruded into rectangular cross section, and produced into ⅛-in.-thick sheet by rolling 50% at 800° C. and final 50% at 650° C. The as-rolled sheet was used to cut into the shape of a knife. The cutting edge in the knife blank was put in by grinding. Two knives were fabricated. Both of the knives were used in kitchen applications at two different locations. At both locations, the knives were used for cutting a variety of products but, most noticeably, tomatoes. The FAL knives were not only sharper than other commercial knives but also showed no sign of corrosion. This was an important observation because the current material is based on aluminum as a major alloying element to iron as opposed to chromium being the major alloying element in commercial knives.

One of the knives described about was put to use in simulating a commercial cutting operation. The FAL knife was used to cut cardboard. A typical knife will cut two to three prices of cardboard before needing to be sharpened. However, the FAL knife cut ten pieces of cardboard and still remained as sharp as before. This shows that knives made with iron aluminide are more resistant to edge dulling than the conventional material used at the present time.

The composition of the iron aluminide investigated is based on iron containing large amounts of aluminum (up to 16 wt. %) as opposed to commercial materials containing large amounts of chromium (12 to 18 wt. %). Chromium is a strategic element and is more expensive than aluminum.

The iron-aluminide compositions are not very hard and do not require any heat treatment for hardness which is needed for the cutting edge. The conventional materials require heat treatments to harden the material for cutting applications.

The cutting edge of iron-aluminide compositions remain sharp much longer than the cutting edge of the conventional material. This was demonstrated by cutting cardboard.

Since high hardness is not required for iron aluminides to perform superbly as a cutting edge, it is believed that some mechanism that allows sharpening as cutting is performed operates in this material. The exact mechanism for this behavior is not fully understood.

Iron aluminide can also be used as a cutting edge by weld deposit or by mechanically attaching the cutting edge to another backing material.

Cutting edges made from iron aluminide can be used in a wide range of manufacturing such as: textile cutting, produce cutting prior to drying and cooking operations, kitchen use, lawn mowers, and hunting.

TABLE I

Ductile compositions of $Fe_3Al$-based alloys

| | Alloy (percent) | | | | | |
|---|---|---|---|---|---|---|
| | FAS[a] | | FAL[b] | | FA-129[c] | |
| Element | Weight | Atomic | Weight | Atomic | Weight | Atomic |
| Al | 15.9 | 28.08 | 15.9 | 28.03 | 15.9 | 28.08 |
| Cr | 2.20 | 2.02 | 5.5 | 5.03 | 5.5 | 5.04 |
| B | 0.01 | 0.04 | 0.01 | 0.04 | — | — |
| Zr | — | — | 0.15 | 0.08 | — | — |
| Nb | — | — | — | — | 1.0 | 0.51 |

TABLE I-continued

Ductile compositions of $Fe_3Al$-based alloys

| | Alloy (percent) | | | | | |
|---|---|---|---|---|---|---|
| | FAS[a] | | FAL[b] | | FA-129[c] | |
| Element | Weight | Atomic | Weight | Atomic | Weight | Atomic |
| C | — | — | — | — | 0.05 | 0.20 |
| Mo | — | — | — | — | — | — |
| Y | — | — | — | — | — | — |
| Fe | Balance | 69.86 | Balance | 66.82 | Balance | 66.17 |

[a]Sulfidation-resistant alloy.
[b]High room-temperature ductility.
[c]High-temperature strength with good room-temperature ductility.

In addition to alloy FAL, iron-aluminide knives have also been fabricated from alloy FA-129. The knife fabricated from alloy FA-129 was used for fabric cutting. For performance comparison, a commercial steel knife of the same configuration was obtained. The performance comparison was based on the following:

1. Hardness: Steel knife—Rockwell C 55-60; FA-129 iron-aluminide knife—Rockwell C 29.5 (as-rolled), Rockwell C 20.5 (as-rolled and annealed). Note that the steel knife needed heat treatment for its increased hardness, which is required for its cutting performance. The iron-aluminide knife was not heat treated. In fact, even if the knife was heat treated, its hardness cannot be increased beyond Rockwell C 29.5. In fact, it decreases in hardness to Rockwell C 20.5.
2. Board Cutting: Identical pieces of ⅛-in.-thick cardboard were used for comparison of cutting response of steel and iron-aluminide knives. In each case, the cut was made using the same stroke, and the same length of cut was made by the same operator. After 12 cuts, it was clear that the steel knife cutting edge was dull as opposed to the iron-aluminide knife, irrespective of the fact that the steel knife was much harder than the iron-aluminide knife.

In order to investigate the possible causes for improved performance, one knife and an associated sheet stock used for knife fabrication were heat treated for 1 h at 800° C. followed by cooling in air. Photomicrographs of the microstructures of the as-rolled and heat-treated sample were compared and show that the iron aluminide in the as-rolled condition contains highly elongated (unrecrystallized) grains. The heat treatment of 1 h at 800° C. develops a fully recrystallized microstructure of fine grains.

The cutting edge was ground into the knives from both the as-rolled and heat-treated stock. A micromirograph of the edges developed in the two conditions showed the edge of the sample in the as-rolled condition as being smoother, whereas, the heat-treated sample showed some rough spots. Both knives were subjected to the cardboard cutting test described above. Over 30 cuts of equal length and stroke by the same operator indicated essentially no difference in the performance. Thus, it is felt that although the as-rolled stock produced a smoother cutting edge, its cutting performance is similar to that of the heat-treated stock.

In order to further determine the cause for enhanced cutting-edge performance of the iron-aluminide knife as opposed to the steel knife, data from the literature on work-hardening rates of various materials are presented in Table II. The work-hardening rate is defined as the force required to result in unit deformation. For comparison purposes, it is presented as a fraction of the shear modulus, G, which is a fundamental property of materials. Note that the data for most of the intermetallic compounds are taken from the compression test, which simulates more closely to the cutting situation. Data in Table II show that the work-hardening rate of most intermetallics is higher than low-carbon steel, 301 stainless steel and pure metals such as Cu, Al, and Ni. The work-hardening rate of FeAl, which is similar to alloy FA-129, is G/7 as opposed to ≈G/50 for low-carbon steel or G/40 for 301 stainless steel. Thus, the work hardening of iron aluminide compared to carbon steel is G/7/G/50-7 or to stainless steel is G/7/G/40~6. These observations suggest that the exceptional performance of iron aluminides results from their very high work-hardening rate as compared to conventional alloys. To put it simply, the forces required to cause a similar damage in iron aluminide will be as much as 6 to 7 times that required for the carbon and stainless steels. The data in Table II also show that although other intermetallics could be used as cutting edges, the iron aluminide provides the most advantage because it has the highest work-hardening rate.

TABLE II

Work-hardening rate[a] of polycrystals[b] (at axial strain of 0.1)

| Material | Work-hardening rate (normalized with respect to the shear modulus, G) | References |
|---|---|---|
| NiAl | G/15–G/38 | Dymek et al. (1992) |
| FeAl+ | G/7 | Baker and Nagpal (1993) |
| $Zr_3Al$ | G/10 | Schulson (1984) |
| $Ni_3Al$ | G/12 | Weihs et al. (1987) |
| $Al_3Sc$ | G/15 | Schneibel and George (1990) |
| $Al_{66}Mn_6V_5Ti_{23}$ | G/15 | Zhang et al. (1990) |
| $Al_{67}Ni_8Ti_{25}$ | G/19 | Turner et al. (1989) |
| Low-carbon steel | ≈G/50 | U.S. Steel (1964) |
| 301 Stainless steel | G/40 | Brickner and Defilippi (1977) |
| Cu, Al, and Ni | G/30–G/40 | Feltham and Meakin (1957) |
| $Cu_3Au$, $Ni_3Mn$, and $Ni_3Fe$ | G/23–G/38 | Schulson (1984) |

[a]For the intermetallics generally obtained from compression tests at room temperature.
[b]Furnace cooled after annealing.

The cutting tests in the as-rolled and the heat-treated conditions also show that iron aluminide can be used as cutting edges in either condition. This suggests that iron aluminide will also perform well as cutting edges in the weld-deposited and ground conditions.

A knife of the present invention cut automotive seat fabric for a significantly longer time than a conventional knife. The test was conducted by a commercial fabric producer.

Another test was conducted to compare a knife of the present invention with a typical pocket knife. Four knives were made out of iron aluminide alloy FA-129 and were fabricated to duplicate the shape of a pocket knife. To be more specific, we tried to duplicate the cutting edge of a stainless steel pocket knife. Both, an iron aluminide knife and the stainless steel pocket knife, were sharpened to a similar finish and used for repetitive cuts on cardboard, wood, plastic, robber and paper. This set of materials was chosen because a typical pocket knife user frequently encounters these situations. Both the iron aluminide knife and stainless steal knife performed equally well in the typical pocket knife cutting operations and dulled at about the same interval. (Note that it is a subjective test). However, the iron aluminide knife slightly out performed the stainless steel pocket knife in cutting cardboard. Both knives could be re-sharpened easily on a ceramic tube.

Cutting tests were conducted on many different materials using knives of the present invention. The knives were able to cut the following materials: kitchen food supplies, cardboard, wood, plastic, rubber, cloth (used for automotive seats), paper, leather, and styrofoam.

The advantages to the present invention are: a) no need for heat treatment, b) lower cost c) nearly five times better performance in fabric cutting for automotive car seats, d) improved performance in cardboard cutting in a highly subjective test, and e) about the same performance in typical pocket knife cutting operations.

While there has been shown and described what is at present considered the preferred embodiments of the invention, it will be obvious to those skilled in the art that various changes and modifications may be made therein without departing from the scope of the invention as defined by the appended claims.

What is claimed is:

1. An article of manufacture comprising an article having a cutting edge, said cutting edge fabricated from an $Fe_3Al$-based alloy having a composition consisting essentially of 15.9 wt % Al, 5.5 wt % Cr, 0.01 wt % B, 0.15 wt % Zr and the remainder being Fe.

2. An article of manufacture comprising an article having a cutting edge, said cutting edge fabricated from an $Fe_3Al$-based alloy having a composition consisting essentially of 15.9 wt % Al, 2.2 wt % Cr, 0.01 wt % B, and the remainder being Fe.

3. An article of manufacture comprising an article having a cutting edge, said cutting edge fabricated from an $Fe_3Al$-based alloy having a composition consisting essentially of 15.9 wt % Al, 5.5 wt % Cr, 1.0 wt % Nb, 0.05 wt % C and the remainder being Fe.

* * * * *